United States Patent [19]

Grant

[11] Patent Number: 4,554,710

[45] Date of Patent: Nov. 26, 1985

[54] TIE TACK

[76] Inventor: Charles R. Grant, 7337 Mission Gorge Rd., Santee, Calif. 92701

[21] Appl. No.: 624,183

[22] Filed: Jun. 25, 1984

[51] Int. Cl.[4] ..... A41D 25/04

[52] U.S. Cl. ..... 24/49 CF; 24/49 CP; 24/49 C; 24/49 TS; 24/304

[58] Field of Search ..... 24/49 CF, 49 R, 49 KC, 24/49 M, 49 CP, 49 P, 49 TS, 49 A, 304, 306, 442

[56] References Cited

U.S. PATENT DOCUMENTS

| | | | |
|---|---|---|---|
| 2,013,061 | 9/1935 | Loewinsohn | 24/49 TS |
| 2,084,503 | 6/1937 | Rogers | 24/49 A |
| 2,161,506 | 6/1939 | De Caracena | 24/49 C |
| 2,990,551 | 7/1961 | Schreter et al. | 24/49 TS |
| 3,370,818 | 2/1968 | Perr | 24/442 |
| 3,405,408 | 10/1968 | Baker | 24/49 CP |
| 3,453,696 | 7/1969 | Mates | 24/306 |
| 3,499,192 | 3/1970 | Holtz | 24/49 P |
| 3,851,357 | 12/1974 | Ribich et al. | 24/306 |
| 3,968,544 | 7/1976 | Sinclair | 24/49 CF |
| 4,123,824 | 11/1978 | Roberts | 24/49 CP |

FOREIGN PATENT DOCUMENTS

| | | | |
|---|---|---|---|
| 217723 | 10/1958 | Australia | 24/49 M |
| 934282 | 10/1955 | Fed. Rep. of Germany | 24/49 M |

*Primary Examiner*—Victor N. Sakran
*Attorney, Agent, or Firm*—Frank D. Gilliam

[57] ABSTRACT

A tie tack for flexibly securing a four-in-hand neck tie to the shirt of the wearer. The tie tack has a cross-bar member for inserting into the button hole of a shirt for securing the tack thereto. A flexible thread extends between the cross-bar and a releasable fastener. A second releasable fastener is adhesively attached to the back surface of the tie adjacent the wearer. The fasteners are of the hook and loop variety with one being a hook type and the other the loop type. When the tie includes a loop, label or such that allows the small back portion of the tie to pass therethrough for securing the two portions together, the fastener is attached to the back surface thereof.

5 Claims, 3 Drawing Figures

TIE TACK

BACKGROUND OF THE INVENTION

This invention relates to a tie tack for releasably securing a four-in-hand necktie to a shirt which does not adversely affect the tie and is hidden from view behind the tie.

Many devices have been created to secure the loose ends of a four-in-hand type necktie. The more well-known devices include conventional tie clasps and tie tacks. However, these devices are necessarily visible when worn, and tie tacks inherently must pierce the neck tie and therefore tend to damage a visible portion after repeated use.

Moreover, many people desire the neat appearance of a secured necktie but prefer a device which is not visible when worn. The most elementary of such devices is a loop which is permanently secured to the inwardly facing surface of the wide end of the necktie and through which is passed the narrow end of the necktie after the knot has been fashioned. A necktie holder is still required.

It has further been known to provide button holes on the surface of the loop in order to secure the necktie to the shirt front or to provide clips integrally on the inward facing surface of the narrow end of the necktie for the same purpose.

U.S. Pat. No. 3,453,696 by inventor J. K. Mates teaches a necktie holder for a four-in-hand necktie which is entirely hidden from view behind the wide end of the necktie when worn. The holder includes a mechanical fastening device for holding the narrow end of the necktie to the shirt. The outer surface of the holder which is positioned outside of the narrow end of the necktie has a first releasable fastening means attached thereto; second releasable fastening means is fixedly secured to the back side of the wide end of the necktie. The fastening means are of the hook and eye type (Velcro) which engage when placed in surface-to-surface contact and are separated by peeling action.

U.S. Pat. No. 4,123,824 by inventor Herbert B. Roberts teaches a tie tack well known in the art comprising a shirt attaching bar, an inner member attached to the bar by a short chain and an outer member 10 which has a pin passing through the necktie and into the central portion of the inner member where it is secured thereto.

SUMMARY OF THE INVENTION

This invention relates to a tie tack which is invisible, does not damage the visible surface of a necktie even after continual use, is inexpensive to produce, has an indefinite life, can be used on different neckties and is easily removable therefrom when desired.

An object of this invention is to provide a tie tack that can be continually used on a necktie and does not damage the outer surface of that necktie.

Another object of this invention is to provide a tie tack which is easily removable from a necktie for use on a different neck tie.

Still another object of this invention is to provide a tie tack which is inexpensive to produce and yet has a long life.

Other objects and advantages of this invention will be apparent from the following description, when taken in conjunction with the accompanying sheet of drawings, in which:

DETAILED DESCRIPTION OF THE INVENTION

Figure 1:
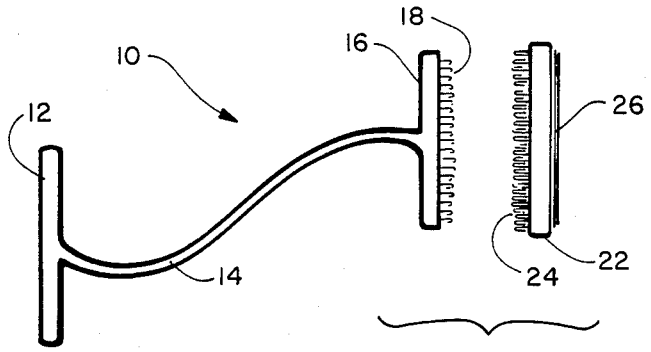
FIG. 1 is a side view of the tie tack embodying the invention.

Referring now to drawing FIG. 1, there is shown a tie tack assembly 10 of the invention. The assembly includes a bar or rod 12 which is designed to be inserted through a shirt button hole and be retained therein by proper orientation thereof. The bar or rod 12 can be constructed of any material suitable for the purpose intended. Some degree of rigidity is required.

Attached to the bar or rod 12 is an elongated, flexible member 14. This elongated, flexible member is constructed of pliable material such as a thread or the like. The thread can be contructed of any suitable material, such as, cotton, silk, wool or the like or manmade material such as plastics or the like. The elongated, flexible member is fixedly connected at one end to the bar or rod 12. This attachment may be by attachment to an aperture through the bar or rod 12, by adhesive attachment thereto, by an integrally formed bar or rod and elongated flexible member as by casting or the like.

A first fastening means 16 is fixedly attached to the opposite end of the elongated flexible member by any means for the purpose intended including those means hereinbefore mentioned for attachment of the opposite end of the elongated flexible member 14 to the bar or rod 12. The front or fastening surface 18 of the first fastening means 16 has fixedly attached thereto either hook or eye fastening material having the trademark Velcro ®.

A second fastening means 22 comprises hook or eye fastening means 24 the opposite of the hook or eye fastening means of first fastening means 16. This enables the two fastening means to attach one to the other in a well known manner. On the opposite or distal surface 26 of the second fastening means 22, is a layer or coating of an adhesive material. An example is that adhesive used on labels, bumber stickers and the like. It should be obvious that any adhesive that can be used to adhere cloth or fabric together could be used to practice this invention.

Figure 2:
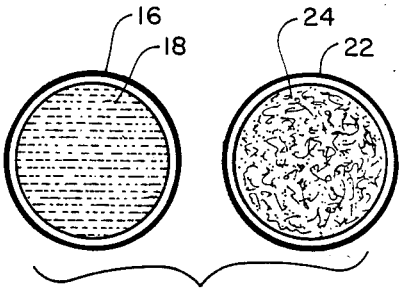
FIG. 2 is a front view of the fastening means.

FIG. 2 depicts the fastening surface of the first and second fastening means. For example, either may be of the hook or eye surface shown.

Figure 3:
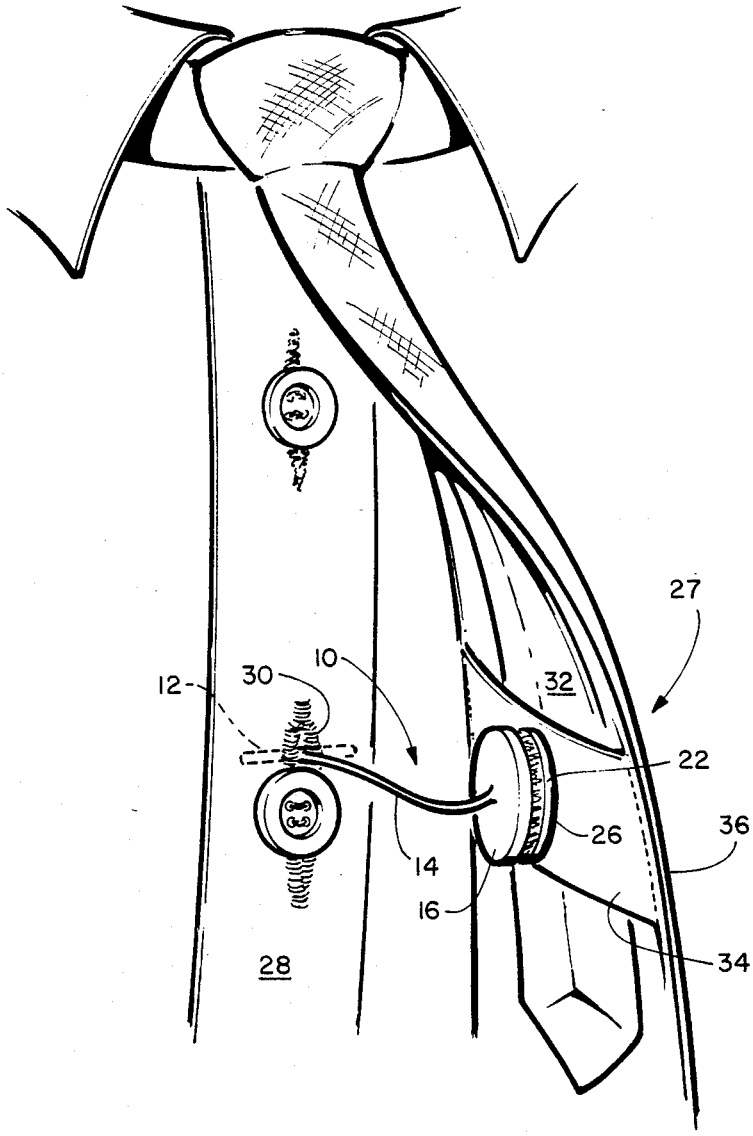
FIG. 3 is a side view of the tie tack of the invention in use.

FIG. 3 depicts the tie tack 10 in position to retain the tie 27 to the wearer's shirt 28 and yet allow sufficient freedom of movement between the tie and shirt.

The bar or rod 12 is shown inserted through a button hole 30 on the front flap of a conventional buttoned shirt. The bar or rod is oriented so that it is retained in the button hole by bearing on the underside of the shirt material on either side of the button hole in a conventional manner. The second fastening means 22 is then pressed against the normally rear or short side 32 of the tie 27. The adhesive on the surface 26 retains the second fastening means in place on the tie as shown in FIG. 3, the surface 26 is shown attached to the normally available loop or cross-member 34. The tie portion 32 has first been inserted through the loop in a normal manner. It should be understood that even if the tie portion 32 is passed through the loop, the surface 26 of second fastening means 22 may be attached in any position along the tie portion 32, which provides the shirt to tie attachment required.

As should be easily understood, where the tie tack is in place as shown in FIG. 3 which includes engaging fasteners 16 and 22, the tie is held in position adjacent the member with a degree of freedom of movement relative to its shirt button hole attachment.

For removal the two fastening means 16 and 22 are peeled one from the other for separation and the bar or rod 12 is repositioned for removal longitudinally from the button hole.

The second fastening means may be left on the tie for future use or may be removed therefrom by peeling and attaching to a second or different tie. Conceivably, a plurality of second fastening means, one for each of a plurality of ties, would be used with a single combined bar or rod, flexible member and first fastening means.

Continuous use of the tie tack 10 of the invention will not result in any damage to the tie back portion 32 or front visible portion 36.

The foregoing specifications sets forth a preferred embodiment of the invention. However, it will be understood that any other adaptations of this invention are intended to be in the scope of this invention as set forth in the following claims.

What is claimed is:

1. A tie tack device for holding a tie in position on the wearer thereof, said tie having front and back portions when worn comprising:

a loop attached to said front portion, said back portion is insertable therethrough for maintaining the two portions in substantial alignment;

a button hole engagement cross-bar shirt attachment means;

a first releasable fastening means;

a flexible member extending between the cross-bar and first fastening means; and a second releasable fastening means fixedly attached to the rear surface of said loop adjacent the wearer and for mating with said first releasable fastening means;

said first and second releasable fastening means comprising fastening elements of the hook and loop type characterized by the property that when placing a surface containing hooks into face-to-face contact with the surface containing loops, a plurality of hooks engage a plurality of loops which resist separation parallel to the inter facial plane of engagement but are readily separable by peeling forces applied substantially normal to the plane.

2. The invention as defined in claim 1 wherein said flexible member is a length of thread.

3. The invention as defined in claim 1 wherein second releasable fastening means is adhesively attached to said tie.

4. The invention as defined in claim 1 wherein said flexible member and cross-bar are integrally formed.

5. The invention as defined in claim 1 wherein said flexible member, cross-bar and a portion of said first releasable fastening means are integrally formed.

* * * * *